US006828076B2

(12) United States Patent
Uchida

(10) Patent No.: US 6,828,076 B2
(45) Date of Patent: Dec. 7, 2004

(54) ELECTROPHOTOSENSITIVE MATERIAL AND METHOD OF PRODUCING THE SAME

(75) Inventor: Maki Uchida, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 10/694,126

(22) Filed: Oct. 27, 2003

(65) Prior Publication Data

US 2004/0063015 A1 Apr. 1, 2004

Related U.S. Application Data

(62) Division of application No. 09/983,471, filed on Oct. 24, 2001, now abandoned.

(30) Foreign Application Priority Data

Oct. 26, 2000 (JP) ..... 2000-326518

(51) Int. Cl.[7] ..... G03G 5/147
(52) U.S. Cl. ..... 430/131; 430/133; 430/60
(58) Field of Search ..... 430/133, 131, 430/60, 64, 65

(56) References Cited

U.S. PATENT DOCUMENTS

| | | | | |
|---|---|---|---|---|
| 4,657,835 A | | 4/1987 | Yashiki | |
| 5,561,022 A | * | 10/1996 | Nogami et al. | 430/131 |
| 5,677,096 A | | 10/1997 | Suzuki | |
| 5,753,395 A | | 5/1998 | Kinoshita et al. | |
| 5,928,824 A | * | 7/1999 | Obinata et al. | 430/131 |
| 5,932,384 A | | 8/1999 | Mitsumori et al. | |
| 5,932,722 A | | 8/1999 | Hirai et al. | |
| 5,942,362 A | | 8/1999 | Tadokoro et al. | |
| 5,948,484 A | * | 9/1999 | Gudimenko et al. | 427/489 |
| 5,955,230 A | | 9/1999 | Kimura et al. | |
| 5,958,638 A | | 9/1999 | Katayama et al. | |
| 5,965,311 A | | 10/1999 | Suzuki | |
| 6,015,646 A | | 1/2000 | Iwasaki et al. | |
| 6,045,957 A | | 4/2000 | Takeshima et al. | |
| 6,120,955 A | | 9/2000 | Tokutake et al. | |
| 6,335,133 B1 | | 1/2002 | Nagasaka | |
| 6,335,390 B1 | * | 1/2002 | Seeger et al. | 524/186 |

FOREIGN PATENT DOCUMENTS

| | | |
|---|---|---|
| JP | 5-19518 | 1/1993 |
| JP | 10-26836 | 1/1998 |
| JP | 11-102081 | 4/1999 |
| JP | 11-344813 | 12/1999 |
| JP | 11-352710 | 12/1999 |
| JP | 2000-3049 | 1/2000 |
| JP | 2000-3051 | 1/2000 |
| JP | 2000-10324 | 1/2000 |
| JP | 2000-56488 | 2/2000 |
| JP | 2000-75510 | 3/2000 |

OTHER PUBLICATIONS

Database WPI, Section Ch. Week 198110, AN 1981–1602d XP002235151 & JP 55 166646 A (Pomoegawa Paper), Dec. 25, 1980 (abstract), Derwent Publications Ltd., London, GB (1 page).

* cited by examiner

*Primary Examiner*—Christopher Rodee
(74) *Attorney, Agent, or Firm*—Smith, Gambrell & Russell, LLP

(57) ABSTRACT

An electrophotosensitive material comprising a supporting substrate, an intermediate layer containing a thermosetting resin formed on the supporting substrate, and a photosensitive layer formed on the intermediate layer, wherein a contact angle of the surface of the intermediate layer is not less than a value (A°) represented by the formula: A°=B°−2° in which B° is a contact angle corresponding to an intersection of a first approximation linear line and a second approximate linear line minus 2° in a correlation curve between a residual potential of the photosensitive material comprising the predetermined photosensitive layer formed on the intermediate layer containing the thermosetting resin and a contact angle of the intermediate layer containing the thermosetting resin. According to this photosensitive material, it is possible to obtain a good image, which has a low residual potential and is free from fog.

4 Claims, 2 Drawing Sheets

ELECTROPHOTOSENSITIVE MATERIAL AND METHOD OF PRODUCING THE SAME

CROSS-REFERENCE TO RELATED APPLICATIONS

This application is a division of application Ser. No. 09/983,471 filed on Oct. 24, 2001, now abandoned, which is relied on and incorporated herein by reference.

BACKGROUND OF THE INVENTION

The present invention relates to an electrophotosensitive material which is used in image forming apparatuses such as laser printer, electrostatic copying machine, plain paper facsimile device, combined device having these functions and the like.

In the image forming apparatuses described above, so-called organic photosensitive materials comprising an electric charge generating material which generates a charge by irradiation with light, an electric charge transferring material which transfers the generated charge, and a binder resin constituting a layer in which these substances are dispersed have widely been used. In general, these organic photosensitive materials are classified roughly into an electrophotosensitive material comprising a single-layer type photosensitive layer wherein the same layer contains an electric charge generating material and an electric charge transferring material, and an electrophotosensitive material comprising a multi-layer type photosensitive layer formed by laminating an electric charge generating layer containing an electric charge generating material and an electric charge transferring layer containing an electric charge transferring material.

Various trials of improving electrophotosensitive materials have hitherto been made and those described in U.S. Pat. No. 6,120,955, U.S. Pat. No. 5,955,230, U.S. Pat. No. 5,958,638, U.S. Pat. No. 5,942,362, U.S. Pat. No. 5,932,384, U.S. Pat. No. 5,932,722, U.S. Pat. No. 5,753,395, U.S. Pat. No. 6,045,957 and U.S. Pat. No. 6,015,646 have been known.

However, conventional electrophotosensitive materials have the following problems at present.

(1) Although the surface of a photosensitive material is charged with a positive or negative electrostatic charge after the charging step during the formation of an image, the bottom of a photosensitive layer is charged with a charge having a polarity which is reverse to the polarity of the surface of the photosensitive material. In case an intermediate layer is absent, the charge generated on the bottom of the photosensitive layer is removed via a conductive supporting substrate. Therefore, when the photosensitive material is subjected to light exposure, the charge of the surface of the photosensitive material is not transferred to the supporting substrate (earth) and remains on the surface of the photosensitive material, thereby to cause image fog.

(2) In case a photosensitive layer is directly coated on a supporting substrate, a photosensitive layer is not sufficiently bound onto the supporting substrate, sometimes, depending on the kind and coating conditions of a binder resin.

(3) In case defects such as scratch are present on the surface of a supporting substrate, black dot is formed on an image.

To solve the problems described above, a method of forming an intermediate layer containing a binder resin on a supporting substrate and forming a photosensitive layer thereon is suggested. According to this method, formation of the intermediate layer prevents a charge generated on the bottom of the photosensitive layer from removing easily and also strong binding of the photosensitive layer on the supporting substrate covers defects on the surface of the supporting substrate, thereby making it possible to smoothen the surface.

The binder resin used in the intermediate is preferably a thermosetting resin. The reason is as follows. That is, when the thermoplastic resin is used, the intermediate layer is dissolved and deteriorated in case an electric charge generating layer is formed on the intermediate layer by coating, depending on the kind of a solvent of a coating solution for electric charge generating layer, thereby making it impossible to coat the electric charge generating layer uniformly and homogeneously.

When the thermosetting resin is used as the binder resin, the intermediate layer is formed by coating a coating solution prepared by dissolving the thermosetting resin in the solvent and subjecting the coated supporting substrate to a heat treatment, thereby to cure the thermosetting binder resin.

However, in case the heat treatment is not sufficiently carried out, the curing degree of the thermosetting resin is reduced, thereby to cause the same problems as in case of the thermoplastic resin. Also since the electric conductivity is lowered, there arises such a problem that the residual potential of the photosensitive material is enhanced. As a result, the toner is developed at the non-image portion, thereby causing image fog.

Since electric characteristics of the photosensitive material can be presumed by measuring the curing degree after forming the intermediate layer, it is made possible to remove defective before forming the photosensitive layer.

As the method of measuring the curing degree of the thermosetting resin, Japanese Published Unexamined Pat. (Kokai Tokkyo Koho Hei) No. 5-19518 discloses a method for quantization of the curing degree, which comprises measuring an absorption intensity ratio of an infrared spectrum originating in an epoxy resin (thermosetting resin) based on the fact that an absorption peak of a carbonyl group in infrared absorption originating in polyester (thermoplastic resin) contained in the surface layer is nearly in a saturated state, thereby to measure a comparative amount of residual epoxy groups.

According to the method described above, in case the use of the thermoplastic resin is not required, the intermediate layer must contain the thermoplastic resin for the purpose of only measuring the curing degree. Moreover, it is troublesome because the measurement of the infrared absorption spectrum requires a long time.

SUMMARY OF THE INVENTION

Thus, an object of the present invention is to solve the technical problems described above and to provide an electrophotosensitive material (sometimes abbreviated to as a "photosensitive material", hereinafter) capable of forming a good image, which has a low residual potential as compared with the prior art and is free from fog.

Another object of the present invention is to provide a method of producing an electrophotosensitive material, which does not forward any defective to the following step, by presuming a residual potential of a photosensitive material in the state of an intermediate during the formation of an intermediate layer.

Still another object of the present invention is to provide a method of producing an electrophotosensitive material, which causes fewer scattering in residual potential.

To solve the problems described above, the present inventors have found a factor, which has a correlation with the curing degree of the thermosetting resin and is easy to measure, and studied to determine an acceptable range of the factor by a correlation between the factor and the residual potential of the photosensitive material.

As a result, they have found that a contact angle is suited for use as the factor. It has been found that the residual potential decreases with an increase in contact angle, while a change in residual potential nearly disappears when the contact angle exceeds a certain value.

An electrophotosensitive material having a contact angle [contact angle which enables the residual potential to become stable] predetermined from a correlation between the contact angle of the intermediate layer and the residual potential of the photosensitive material on the basis of the correlation described above is produced, thus completing the present invention.

The electrophotosensitive material of the present invention comprises a supporting substrate, an intermediate layer containing a thermosetting resin formed on the supporting substrate, and a photosensitive layer formed on the intermediate layer, wherein a contact angle of the surface of the intermediate layer is not less than a value (A°) represented by the formula: $A°=B°-2°$ in which B° is a contact angle corresponding to an intersection of a first approximation linear line and a second approximate linear line in a correlation curve between a residual potential of the photosensitive material comprising the predetermined photosensitive layer formed on the intermediate layer containing the thermosetting resin and a contact angle of the intermediate layer containing the thermosetting resin; and the first approximate linear line denotes an approximate linear line of the portion where the residual potential decreases proportionally with an increase in contact angle in the correlation curve, while the second approximate linear line denotes an approximate linear line of the portion where a change in residual potential with an increase in contact angle nearly disappears.

The first method of producing an electrophotosensitive material of the present invention comprises forming an intermediate layer containing a thermosetting resin on a supporting substrate, measuring a contact angle of the surface of the intermediate layer, and forming a photosensitive layer on the intermediate layer when the contact angle is within a predetermined range.

The second method of producing an electrophotosensitive material of the present invention comprises forming an intermediate layer containing a thermosetting resin on a supporting substrate, carrying out a heat treatment so that a contact angle is set within a predetermined range, and forming a photosensitive layer on the intermediate layer when the contact angle is within a predetermined range.

The electrophotosensitive material of the present invention is capable of forming a good image, which has a low residual potential and is free from fog. According to the first method of producing an electrophotosensitive material of the present invention, since a residual potential of a photosensitive material can be presumed in the state of an intermediate during the formation of an intermediate layer, it does not forward any defective to the following step. Also according to the second method of producing an electrophotosensitive material of the present invention, since an intermediate layer is formed under heat treatment conditions which reduce scattering in residual potential, it is made possible to stabilize the quality.

DETAILED DESCRIPTION OF THE INVENTION

Figure 1:
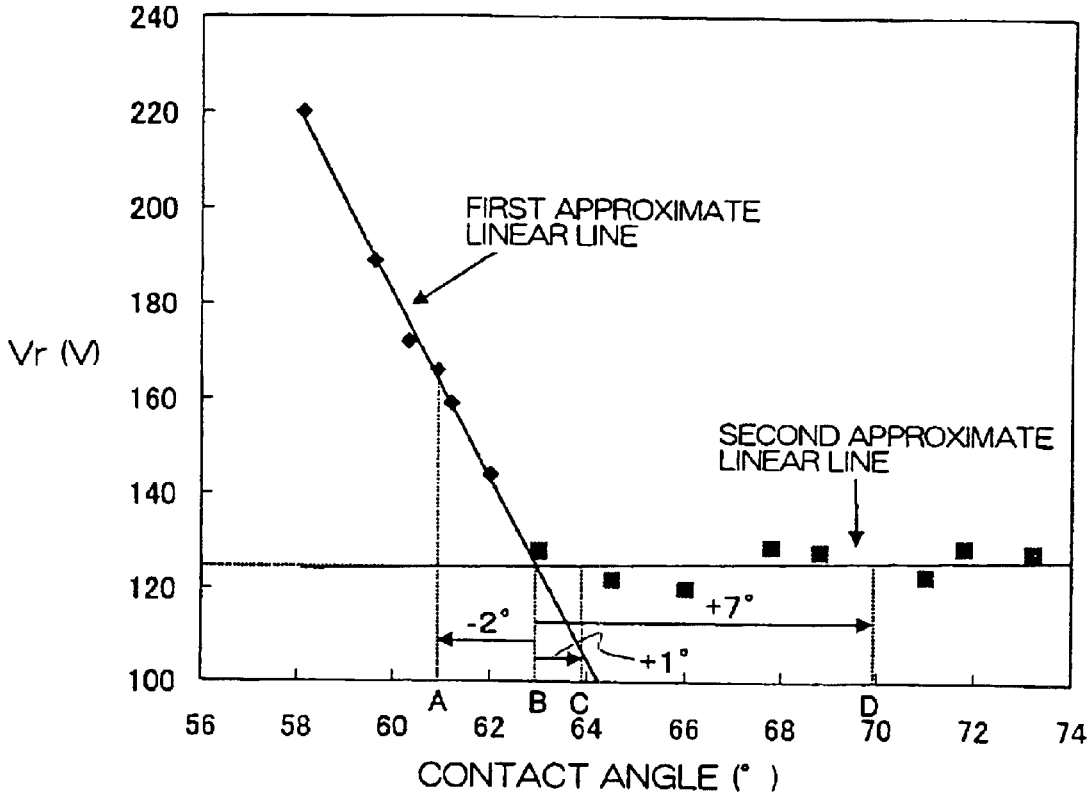
FIG. 1 is a graph showing a correlation between the residual potential of an electrophotosensitive material and the contact angle of an intermediate layer in Example 1.

The electrophotosensitive material and method of producing the same of the present invention will be described in detail below.

The electrophotosensitive material of the present invention is an electrophotosensitive material produced by forming an intermediate layer containing a thermosetting resin on the supporting substrate, contact angle of the surface of the intermediate layer being a value determined by a correlation between the contact angle of the intermediate layer and the residual potential of the photosensitive material so that the residual potential is nearly stabilized, and forming a photosensitive material having a single-layer or multi-layer structure on the intermediate layer.

Each constitution of the electrophotosensitive material of the present invention will be described below.

<<Intermediate Layer>>

<Layer Constitution>

The intermediate layer of the electrophotosensitive material of the present invention contains, as a main component, a thermosetting resin as a binder resin. In case the intermediate layer contains a pigment, the amount of the pigment may be within a range from 5 to 500 parts by weight, and preferably from 20 to 250 parts by weight, based on 100 parts by weight of the binder resin. The thickness of the intermediate layer is within a range from 0.1 to 50 $\mu$m, and preferably from 0.5 to 30 $\mu$m.

(Binder Resin)

The binder resin used in the intermediate layer of the electrophotosensitive material of the present invention is a thermosetting resin and there can be used various resins which have conventionally been used in the photosensitive layer. Examples thereof include silicone resin, epoxy resin, phenol resin, urea resin, melamine resin, and other crosslinkable thermosetting resins.

The intermediate layer of the photosensitive material of the present invention can contain resins, for example, thermoplastic resin such as styrene-butadiene copolymer, styrene-acrylonitrile copolymer, styrene-maleic acid copolymer, acrylic copolymer, styrene-acrylic acid copolymer, polyethylene, ethylene-vinyl acetate copolymer, chlorinated polyethylene, polyvinyl chloride, polypropylene, ionomer, vinyl chloride-vinyl acetate copolymer, polyester, alkyd resin, polyamide, polyurethane, polycarbonate, polyallylate, polysulfone, diallyl phthalate, ketone resin, polyvinyl butyral resin, polyether resin, or polyester resin; and photocurable resin such as epoxy acrylate or urethane acrylate; as far as an adverse influence is not exerted on characteristics and productivity of the photosensitive material.

(Pigment)

The intermediate layer of the electrophotosensitive material according to the present invention can contain a pigment to enhance the conductivity of the intermediate layer and to prevent interference fringe from occurring. As the pigment used in the present invention, publicly known organic pigments and inorganic pigments can be applied. Examples thereof include organic pigments such as various phthalocyanine pigments, polycyclic quinone pigment, azo pigment, perylene pigment, indigo pigment, quinacridone pigment, azulenium pigment, squalirium pigment, cyanine pigment, pyrylium dye, thiopyrylium dye, xanthene dye, quinoneimine pigment, triphenylmethane pigment, styryl pigment, anthanthrone pigment, threne pigment, toluidine pigment, and pyrrazoline pigment; and inorganic pigments such as metal oxide (e.g. titanium oxide, iron oxide, aluminum oxide, tin oxide, zinc oxide, etc.) and carbon black. These pigments can be used alone or in combination.

(Contact Angle)

In the electrophotosensitive material of the present invention, the contact angle of the surface of the intermediate layer is used as a measure of the curing degree of the thermosetting resin.

It is necessary to previously determine the correlation between the residual potential of the photosensitive material and the contact angle of the intermediate layer. To determine the correlation, intermediate layers having different curing degrees are formed by varying heat treatment conditions of the thermosetting resin to be used and, after measuring the contact angle, a photosensitive layer is formed on each of the intermediate layers under the same conditions.

The correlation between the residual potential and the contact angle was shown in FIG. 1. As shown in FIG. 1, with an increase in contact angle, a certain value of the contact angle (point B: 62.9° in FIG. 1) as a border generally divides the first correlation portion where the residual potential decreases proportionally from the second portion where a change in residual potential nearly disappears even if the contact angle increases.

Then, a first approximate linear line which approximates the first correlation portion and a second approximate linear line which approximates the second correlation portion are made. The first approximate linear line is made by approximation of measured values of the residual potential and the contact angle in the first correlation portion, using a least-square method. The second approximate linear line is made by approximation of measured values in the second correlation portion in the same manner as in case of the first approximate linear line. In the present invention, a correlation curve is made by combining the first approximate linear line with the second approximate linear line.

Finally, a proper range of the contact angle is determined from the correlation curve thus obtained. Specifically, the contact angle (B°) corresponding to an intersection of the first and second approximate linear lines and then the value not less than the value (A°) represented by the formula: A°=B°−2° (point A: 60.9° in the example of FIG. 1) is taken as a value within the proper range. More preferably, the value is within a range from the value corresponding to the intersection plus 1° to the value corresponding to the intersection plus 7° (ranging from point C to point D: 63.9° to 69.9° in the example of FIG. 1)

When the contact angle is smaller than the value corresponding to the intersection minus 2°, image fog is likely to occur because of the increase in residual potential, and also scattering in residual potential due to a difference between manufacturing lots. When the contact angle is within a range from the intersection (point B)±0°, since a change in residual potential to the contact angle nearly disappears, the problems described above can be nearly solved. In view of the measurement error and the difference in material between lots, scattering in residual potential can be surely suppressed by controlling the contact angle to the value corresponding to the intersection plus 1°.

When the contact angle is not less than the value corresponding to the intersection plus 7°, since heat treatment conditions become severe, the heat treatment temperature must be raised and the heat treatment time must be lengthened, resulting in reduction of the production efficiency.

In the electrophotosensitive material of the present invention, the contact angle of the surface of the intermediate layer is within the proper range of the contact angle thus determined above.

The contact angle is preferably measured by a sessile drop method. The correlation must be determined under the same measuring conditions as those in case of producing the electrophotosensitive material. Water used in the measurement of the contact angle is preferably water having high purity, such as pure water, deionized water, distilled water or the like.

Figure 3:
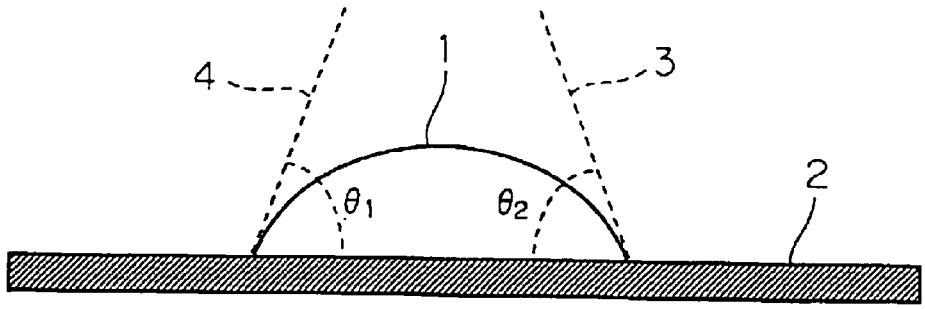
FIG. 3 is a schematic diagram for explaining a method of measuring a contact angle.

FIG. 3 is a schematic diagram for explaining a method of measuring a contact angle using a sessile drop method. In this measuring method, a measuring sample 2 comprising a supporting substrate and an intermediate layer formed on the supporting substrate is placed so that the surface of the intermediate layer is horizontal, first. Then, water 1 is dropped on the intermediate layer and angles $\theta_1$ and $\theta_2$ between tangent lines 3 and 4 of ends of water 1 and the measuring sample 2 (surface of the intermediate layer) are measured. An average value of the angles $\theta_1$ and $\theta_2$ is taken as a contact angle.

Measuring samples for determination of the residual potential and the contact angle to be used may be made of electrophotosensitive materials in which the intermediate layers are formed under different heat treatment conditions.

Heat treatment conditions include a heat treatment temperature and a heat treatment time. Measuring samples having different curing degrees may be made by varying the temperature and time. Since the contact angle of the intermediate layer has a correlation with the curing degree of the thermosetting resin, as described above, samples having the same curing degree exhibit the same contact angle even if the heat treatment is carried out under different conditions.

<<Supporting Substrate>>

As the supporting substrate used in the present invention, for example, various materials having the conductivity can be used and examples thereof include metallic simple substances such as iron, aluminum, copper, tin, platinum, silver, vanadium, molybdenum, chromium, cadmium, titanium, nickel, palladium, indium, stainless steel and brass; plastic materials prepared by depositing or laminating the above metals; and glasses coated with aluminum iodide, tin oxide and indium oxide.

The supporting substrate may be in the form of a sheet or drum according to the structure of the image forming apparatus to be used. The supporting substrate itself may have the conductivity, or the surface of the supporting substrate may have the conductivity. The supporting substrate may be preferably those having a sufficient mechanical strength when used.

The surface of the supporting substrate may be subjected to a surface treatment such as roughening treatment, oxidizing treatment, etching or the like.

<<Photosensitive Layer>>

The photosensitive layer in the electrophotosensitive material of the present invention is classified into a single-layer type electrophotosensitive material and a multi-layer type electrophotosensitive material according to its constitution. The single-layer type photosensitive material is obtained by forming a single photosensitive layer containing at least an electric charge transferring material, an electric charge generating material and a binder resin on a supporting substrate. The multi-layer type photosensitive material is obtained by forming an electric charge generating layer containing an electric charge generating material and an electric charge transferring layer containing an electric charge transferring material on a supporting substrate in this order or a reverse order. As details of the photosensitive layer constitution of the single-layer type and multi-layer type photosensitive materials, specific examples and the mixing ratio of the electric charge generating material and electric charge transferring material, the method of forming the photosensitive layer, additives which may be optionally added, in addition to the binder resin, electric charge generating material and electric charge transferring material, and layers which may be formed, in addition to the photosensitive layer, for example, there can be used those which have conventionally been known. These facts are described in detail in Japanese Published Unexamined Patent (Kokai Tokkyo Koho Hei) No. 10-26836, Japanese Published Unexamined Patent (Kokai Tokkyo Koho Hei) 11-102081, Japanese Published Unexamined Patent (Kokai Tokkyo Koho Hei) 11-344813, Japanese Published Unexamined Patent (Kokai Tokkyo Koho Hei) 11-352710, Japanese Published Unexamined Patent (Kokai Tokkyo Koho) No. 2000-3049, Japanese Published Unexamined Patent (Kokai Tokkyo Koho) No. 2000-3051, Japanese Published Unexamined Patent (Kokai Tokkyo Koho) No. 2000-10324, Japanese Published Unexamined Patent (Kokai Tokkyo Koho) No. 2000-56488 (U.S. Pat. No. 6,045,957), and Japanese Published Unexamined Patent (Kokai Tokkyo Koho) No. 2000-75510.

The method of producing the electrophotosensitive material of the present invention will be described below.

<<Formation of Intermediate Layer>>

An intermediate layer is formed on a supporting substrate in which a surface treatment such as washing treatment, roughening treatment, anodizing treatment or the like have been completed in the following manner.

In case the intermediate layer is formed by a coating method, a coating solution is prepared by dispersing and mixing the above-described binder resins and compounds (1) and, if necessary, pigments, together with proper dispersion mediums, using a known method such as roll mill, ball mill, attritor, paint shaker, ultrasonic dispersing equipment or the like and the resulting coating solution is coated by a known means such as blade method, dipping method, spraying method or the like. Then, a heat treatment is carried out, thereby to cure a thermosetting resin as the binder resin, and a dispersion medium is evaporated.

As the dispersion medium for preparing the coating solution, conventionally known organic solvents can be used. Examples thereof include alcohols such as methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, chloroform, carbon tetrachloride and chlorobenzene; ethers such as dimethyl ether, diethyl ether, tetrahydrofuran, ethylene glycol dimethyl ether and diethylene glycol dimethyl ether; ketones such as acetone, methyl ethyl ketone and cylohexanone; esters such as ethyl acetate and methyl acetate; and dimethylformaldehyde, dimethylformamide and dimethyl sulfoxide.

To improve the dispersibility of the electric charge transferring material and electric charge generating material, and the smoothness of the surface of the photosensitive layer, for example, surfactants and leveling agents may be used.

The intermediate layer thus formed is measured by the contact angle by the method described above. If the measure value of the contact angle is within an acceptable range determined by the method, a photosensitive layer is subsequently formed to produce a photosensitive material.

The heat treatment conditions may be previously set so that the contact angle is within an acceptable range and, when using heat treatment conditions which enable a change in residual potential with an increase in contact angle to nearly disappear in the correlation between the residual potential and the contact angle, scattering in quality of the photosensitive material is reduced and, therefore, it is preferred.

In case of the heat treatment, a rise of the treatment temperature is more effective to enhance the hardness than as compared with an extension of the treatment time.

<<Formation of Photosensitive Layer>>

After forming the intermediate layer, a photosensitive layer is formed on the intermediate layer. In the formation of the photosensitive layer, a conventionally known coating method can also be used similarly to the formation of the intermediate layer.

The electrophotosensitive material of the present invention can also be produced by forming the intermediate layer as described in the electrophotosensitive materials described in U.S. Pat. No. 6,120,955, U.S. Pat. No. 5,955,230, U.S. Pat. No. 5,958,638, U.S. Pat. No. 5,942,362, U.S. Pat. No. 5,932,384, U.S. Pat. No. 5,932,722, U.S. Pat. No. 5,753,395, and U.S. Pat. No. 6,015,646.

EXAMPLES

The following Examples and Comparative Examples further illustrate the present invention.

<<Multi-Layer Type Photosensitive Material>>

Example 1

(Formation of Intermediate Layer)

10 Parts by weight of diacetone alcohol as the compound (1), 60 parts by weight of a phenol resin (TD447, manufactured by DAINIPPON INK & CHEMICALS Co., Ltd.) as the binder resin, 100 parts by weight of titanium oxide (TA-300, manufactured by FUJI TITANIUM INDUSTRY Co., LTD.) as the pigment and 100 parts by weight of methanol as the dispersion medium were mixed and dispersed in a ball mill (zirconia beads of 1 ϕ in diameter) for 24 hours to prepare a coating solution for intermediate layer. Then, an alumina tube (supporting substrate) of 30 ϕ in diameter was coated with the coating solution using a Teflon blade, thereby to form an intermediate layer having a thickness of 10 μm under heat treatment conditions shown in Table 1, thus obtaining an intermediate of an electrophotosensitive material. It has been confirmed from Table 1 that the higher the temperature or the longer the heat treatment at the same temperature, the more the contact angle increases.

TABLE 1

| | | (Reference value) | | | |
|---|---|---|---|---|---|
| Sample No. | Treatment temperature (° C.) | Treatment time (min.) | Contact angle (degree) | Residual potential $V_r$ (V) | Image fog |
| 1-1 | 120 | 30 | 58.1 | 220 | × |
| 1-2 | 120 | 60 | 59.6 | 189 | × |
| 1-3 | 140 | 10 | 60.3 | 172 | Δ |
| 1-4 | 140 | 15 | 60.9 | 166 | ○ |
| 1-5 | 140 | 20 | 61.2 | 159 | ○ |
| 1-6 | 140 | 30 | 62 | 144 | ○ |

TABLE 1-continued

| Sample No. | Treatment temperature (° C.) | Treatment time (min.) | Contact angle (degree) | Residual potential $V_r$ (V) | Image fog |
|---|---|---|---|---|---|
| | | (Reference value) | | | |
| 1-7 | 150 | 15 | 63 | 128 | ○ |
| 1-8 | 150 | 20 | 64.5 | 122 | ○ |
| 1-9 | 150 | 25 | 66 | 120 | ○ |
| 1-10 | 150 | 30 | 67.8 | 129 | ○ |
| 1-11 | 150 | 45 | 68.8 | 128 | ○ |
| 1-12 | 150 | 60 | 71 | 123 | ○ |
| 1-13 | 160 | 15 | 71.8 | 129 | ○ |
| 1-14 | 160 | 20 | 73.2 | 128 | ○ |
| 1-15 | 160 | 25 | 75.2 | 121 | ○ |
| 1-16 | 160 | 30 | 76 | 129 | ○ |

(Measurement of Contact Angle)

Using a contact angle measuring device (FACE MODEL CA-S roll, manufactured by Kyowa Interface Science Co., LTD.), a contact angle to the surface of this intermediate was measured by the sessile drop method. Measuring conditions are as follows.

Measuring environment: room temperature of 20° C./humidity of 50%

Measuring water: deionized water (allowed to stand up to a water temperature of 20° C.)

Number of samples: 3 (average value was taken as a contact angle)

The measurement results are shown in Table 1.

(Formation of Photosensitive Layer)

After the measurement of the contact angle, 1 part by weight of Y type titanyl phthalocyanine as the pigment was added to 39 parts by weight of ethylcellosolve as the dispersion medium and then primarily dispersed using an ultrasonic dispersing machine. To this dispersion, a solution prepared by dissolving 1 part by weight of polyvinyl butyral (BM-1, manufactured by SEKISUI CHEMICAL CO., LTD.) as the binder resin in 9 parts by weight of ethylcellosolve was added and then secondarily dispersed using an ultrasonic dispersing machine again to prepare a coating solution for electric charge generating layer out of a multi-layer type photosensitive layer. The intermediate was coated with this coating solution using a Teflon blade, followed by drying at 110° C. for five minutes, thereby to form an electric charge generating layer having a thickness of 0.5 μm.

Then, 0.05 parts by weight of 3,3',5,5'-tetra-tert-4,4'-diphenoquinone as the electron transferring material, 0.8 parts by weight of N,N,N',N'-tetrakis(3-methylphenyl)-1,3-diaminobenzene as the hole transferring material, 0.95 parts by weight of Z type polycarbonate (Panlite TS2050, manufactured by Teijin Chemicals, Ltd.) as the binder resin, 0.05 parts by weight of a polyester resin (RV200, manufactured by Toyobo Co., Ltd.) and 8 parts by weight of tetrahydrofuran were mixed and dispersed to obtain a coating solution for electric charge transferring layer. This coating solution was coated on the electric charge generating layer using a Teflon blade, followed by drying at 110° C. for 30 minutes, thereby to form an electric charge transferring layer having a thickness of 30 μm, thus obtaining a multi-layer type electrophotosensitive material.

(Measurement of Residual Potential)

Using a drum sensitivity tester (manufactured by GEN-TEC Co.), a voltage was applied on the surface of each electrophotosensitive material thus obtained by subjecting to each heat treatment as described above to charge the surface at −700±20 V and an initial surface potential $V_0$ (V) was measured. Then, monochromic light (light intensity I=16 μW/cm$^2$) having a wavelength of 780 nm (half-width: 20 nm) from white light of a halogen lamp as an exposure light source through a band-pass filter was irradiated on the surface of each photosensitive material (irradiation time: 80 milliseconds) and a surface potential at the time at which 330 seconds have passed since the beginning of exposure was measured as a residual potential $V_r$ (V). The results are shown in Table 1.

(Evaluation of Image)

With respect to the respective photosensitive materials obtained in Example 1, images in the form of a black-white strip were printed and image fog of the tenth print from starting was visually observed. Evaluation was carried out according to the following criteria.

○: Image fog can not be recognized visually.

Δ: Image fog/interference fringe can be recognized.

X: Severe image fog can be recognized clearly.

The evaluation results of the image of the photosensitive materials used in the respective Examples are shown in Table 1.

(Correlation Between Residual Potential and Contact Angle)

The above measurement results were plotted with the residual potential as coordinate against the contact angle as abscissa, and then a correlation curve was obtained from these plots using a least-square method and was shown in FIG. 1. In FIG. 1, the first approximate linear line is made by approximation of plots based on data of samples (1-1) to (1-7) in Table 1, while the second approximate linear line is made by approximation of plots based on data of samples (1-7) to (1-16). The contact angle in the intersection (point B) of the first and second approximate linear lines was 62.9°. Accordingly, the point A (60.9°) not less than the value corresponding to the intersection minus 2° is within a proper range. As is apparent from Table 1, the occurrence of image fog was recognized in the photosensitive materials of the samples (1-1) to (1-3) having the contact angle of smaller than 60.9°. On the other hand, good images free from fog were obtained in the photosensitive materials of the samples (1-4) to (1-16) having a contact angle of 60.9° or more.

As is apparent from FIG. 1, the residual potential $V_r$ becomes stable at about 124 V when the contact angle is 62.9° or more. Accordingly, if the intermediate layer is formed under the heat treatment conditions so that the contact angle becomes the point B plus 1°, i.e. 63.9° (point C) or more, scattering in residual potential $V_r$ between rots is markedly reduced.

In Table 1, the heat treatment temperature of the sample (1-8) having the smallest contact angle within a range from the point B plus 1° to the point B plus 7° (point C to Point D), i.e. 63.9° to 69.9°, is 150° C., and the heat treatment time thereof is 20 minutes. The heat treatment temperature of the sample (1-12) having a contact angle, which is not within the above range and is most close to the upper limit, is 150° C., and the heat treatment time thereof is 60 minutes. The heat treatment hour of the sample (1-12) is three times longer than that of the sample (1-8) and, therefore, the production efficiency is drastically lowered. Accordingly, the photosensitive material can be produced at the contact angle within a range from 63.9 to 69.9° without extending the heat treatment time excessively.

Example 2

(Formation of Intermediate Layer)

10 Parts by weight of diacetone alcohol as the compound (1), 60 parts by weight of a phenol resin (TD447, manufactured by DAINIPPON INK & CHEMICALS Co., Ltd.) as the binder resin, 100 parts by weight of titanium oxide (TTO-55N, manufactured by ISHIHARA SANGYO KAISYA LTD.) as the pigment and 100 parts by weight of methanol as the dispersion medium were mixed and dispersed in a ball mill (zirconia beads of 1 ϕ in diameter) for 24 hours to prepare a coating solution for intermediate layer. Then, an alumina tube (supporting substrate) of 30 ϕ in diameter was coated with the coating solution using a Teflon blade, thereby to form an intermediate layer having a thickness of 10 μm under heat treatment conditions shown in Table 2, thus obtaining an intermediate of an electrophotosensitive material. It has been confirmed from Table 1 that the higher the temperature or the longer the heat treatment time at the same temperature, the more the contact angle increases.

(Measurement of Contact Angle)

In the same manner as in Example 1, a contact angle to the surface of this intermediate was measured. The results are shown in Table 2.

TABLE 2

| Sample No. | Treatment temperature (° C.) | Treatment time (min.) | Contact angle (degree) | Residual potential $V_r$ (V) | Image fog |
|---|---|---|---|---|---|
| 2-1 | 120 | 10 | 57.1 | 235 | × |
| 2-2 | 130 | 15 | 59.2 | 198 | × |
| 2-3 | 130 | 30 | 60.1 | 175 | Δ |
| 2-4 | 140 | 25 | 61.6 | 159 | ○ |
| 2-5 | 140 | 35 | 62.8 | 143 | ○ |
| 2-6 | 145 | 25 | 63.8 | 137 | ○ |
| 2-7 | 145 | 30 | 64.8 | 135 | ○ |
| 2-8 | 145 | 35 | 65.2 | 144 | ○ |
| 2-9 | 150 | 25 | 66 | 143 | ○ |
| 2-10 | 150 | 30 | 67 | 138 | ○ |
| 2-11 | 155 | 20 | 67.7 | 144 | ○ |
| 2-12 | 155 | 25 | 69.1 | 143 | ○ |
| 2-13 | 155 | 30 | 71.2 | 136 | ○ |
| 2-14 | 160 | 15 | 72 | 144 | ○ |

(Formation of Photosensitive Layer)

In the same manner as in Example 1, an electric charge generating layer and an electric charge transferring layer were formed, thereby to obtain a multi-layer type electrophotosensitive material.

(Measurement of Residual Potential)

In the same manner as in Example 1, a residual potential $V_r$ (V) was measured. The results are shown in Table 2.

(Evaluation of Image)

In the same manner as in Example 1, image fog was visually observed. The results are shown in Table 2.

(Correlation Between Residual Potential and Contact Angle)

Figure 2:
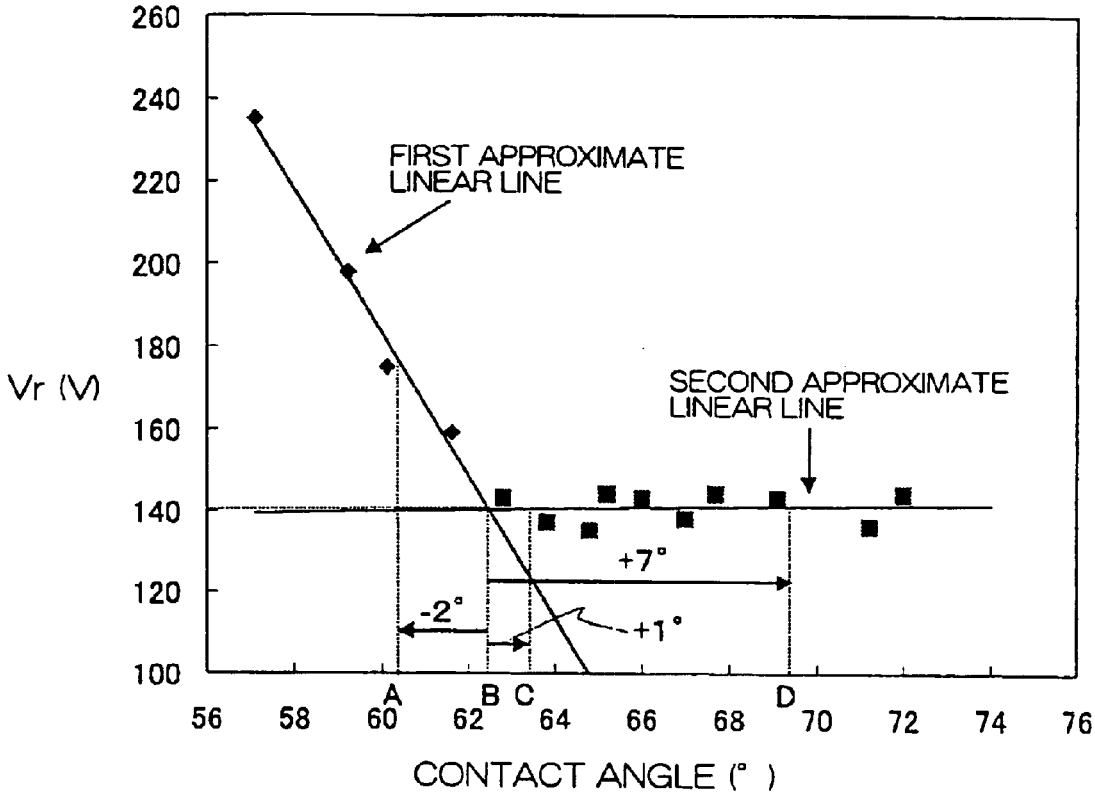
FIG. 2 is a graph showing a correlation between the residual potential of an electrophotosensitive material and the contact angle of an intermediate layer in Example 2.

The above measurement results were plotted with the residual potential as coordinate against the contact angle as abscissa, and then a correlation curve was obtained from these plots using a least-square method and was shown in FIG. 2. In FIG. 2, the first approximate linear line is made by approximation of plots based on data of samples (2-1) to (2-5) in Table 1, while the second approximate linear line is made by approximation of plots based on data of samples (2-5) to (2-14). The contact angle in the intersection (point B) of the first and second approximate linear lines was 62.4°. Accordingly, the point A (60.4°) not less than the value corresponding to the intersection minus 2° is within a proper range. As is apparent from Table 1, the occurrence of image fog was recognized in the photosensitive materials of the samples (2-1) to (2-3) having the contact angle of smaller than 60.4°. On the other hand, good images free from fog were obtained in the photosensitive materials of the samples (2-4) to (2-14).

As is apparent from FIG. 2, the residual potential $V_r$ becomes stable at about 140 V when the contact angle is 62.4° or more. Accordingly, if the intermediate layer is formed under the heat treatment conditions so that the contact angle becomes the point B plus 1°, i.e. 63.4° (point C) or more, scattering in residual potential $V_r$ between rots is markedly reduced.

In Table 2, the heat treatment temperature of the sample (2-6) having the smallest contact angle within a range from the point B plus 1° to the point B plus 7°, i.e. 63.4 to 69.4°, is 145° C., while the heat treatment time thereof is 25 minutes. The heat treatment temperature of the sample (2-13) having a contact angle, which is not within the above range and is most close to the upper limit, is 155° C., while the heat treatment time thereof is 30 minutes. The heat treatment temperature of the sample (2-13) is 10° C. higher than that of the sample (2-6) and the heat treatment time is also longer. Therefore, the production efficiency is lowered in view of both the temperature and time of the heat treatment. Accordingly, the photosensitive material can be produced at the contact angle within a range from 63.4 to 69.4° without raising the heat treatment temperature or extending the heat treatment time excessively.

What is claimed is:

1. A method for producing an electrophotosensitive material comprising providing a supporting substrate, forming an intermediate layer containing a thermosetting resin on the supporting substrate by depositing said intermediate layer on said supporting substrate, to thereby form a surface of the intermediate layer on said supporting substrate, carrying out a heat treatment so that the water contact angle is set within a predetermined range, and then measuring a water contact angle of the surface of the intermediate layer, then forming a photosensitive layer on the surface of said intermediate layer, wherein the water contact angle is within a predetermined range which is defined as being not less that A°, wherein A°=B°−2°, in which B°is a water contact angle corresponding to an intersection of a first approximate linear line and a second approximate linear line in a correlation curve between a residual potential of the electrophotosensitive material and a water contact angle of the intermediate layer;

wherein the first approximate linear line denotes an approximate linear line of a portion of said correlation curve where the residual potential decreases proportionally with an increase in water contact angle, while the second approximate linear line denotes an approximate linear line of the portion of the correlation curve where a change in residual potential with an increase in contact angle nearly disappears;

said correlation curve having been previously determined by measurement of residual potential for specific electrophotosensitive materials and plotting values obtained for residual potential as coordinate against contact angles as abscissa and obtaining said correlation curve by a least-square method.

2. The method for producing an electrophotosensitive material according to claim 1, wherein the correlation curve is derived form values as measured under plural heat treatment conditions for curing the thermosetting resin when the intermediate layer is formed.

3. The method for producing an electrophotosensitive material according to claim 1, wherein the water contact angle is within a range from the value corresponding to the intersection plus 1° to the value corresponding to the intersection plus 7°.

4. The method for producing an electrophotosensitive material according to claim 1, further comprising introducing a pigment into said intermediate layer.

* * * * *